United States Patent [19]

Nill

[11] Patent Number: 4,634,922

[45] Date of Patent: Jan. 6, 1987

[54] METHOD OF MANUFACTURING AND ADJUSTING A COLOR PICTURE REPRODUCTION UNIT

[75] Inventor: Eberhard Nill, Oberesslingen, Fed. Rep. of Germany

[73] Assignee: ITT Industries, Inc., New York, N.Y.

[21] Appl. No.: 682,669

[22] Filed: Dec. 17, 1984

[30] Foreign Application Priority Data

Dec. 22, 1983 [DE] Fed. Rep. of Germany ..... 3346363

[51] Int. Cl.[4] ..... H01J 29/07; H01J 29/51

[52] U.S. Cl. ..... 313/402; 313/421; 313/428; 315/368; 315/387

[58] Field of Search ..... 313/402, 407, 421, 425, 313/427, 428; 315/368, 387

[56] References Cited

U.S. PATENT DOCUMENTS 2,611,003 9/1952 Friend ..... 313/425 X 4,456,853 6/1984 Robinder et al. ..... 313/421

*Primary Examiner*—David K. Moore

*Assistant Examiner*—K. Wieder

*Attorney, Agent, or Firm*—Donald J. Lenkszus

[57] ABSTRACT

A color picture tube comprising three electron-gun systems, in which on the shadow mask or a part connected thereto, phosphorescent marks are attached to the rear side thereof. These marks can be used for checking the exact position of the electron beams during adjustment. By suitably delaying the chrominance signals it is possible to improve the E-W convergence.

9 Claims, 3 Drawing Figures

METHOD OF MANUFACTURING AND ADJUSTING A COLOR PICTURE REPRODUCTION UNIT

CROSS-REFERENCE TO RELATED APPLICATION

U.S. patent application Ser. No. 682,419 filed Dec. 17, 1984 to the same inventor herein and having a common assignee.

BACKGROUND OF THE INVENTION

The invention relates to a color picture tube, to a color picture reproduction unit comprising such a color picture tube, and to a method of adjusting such a color picture reproduction unit.

Reproduction fidelity requirements for color picture tubes have increased considerably due to the frequent reproduction of graphics and texts in which geometric distortions and convergence errors are readily apparent. A high fidelity of reproduction is already achievable by employing self-convergent deflection systems and by taking diversified switching methods. It is possible to still further increase the fidelity of reproduction, when individual errors are compensated. This, however, requires that such deviations be detected as accurately as possible (during the first alignment and the servicing) and, if so required, also as often as possible (for making continuous corrections during operation).

SUMMARY OF THE INVENTION

It is an object of the invention to provide possibilities for detecting and correcting picture distortions.

There is presented a color picture tube comprising three electron-gun systems, in which on the shadow mask or a part connected thereto, phosphorescent marks are attached to the rear side thereof. These marks can be used for checking the exact position of the electron beams during adjustment. By suitably delaying the chrominance signals it is possible to improve the E-W convergence.

Geometric and convergence distortions in the E-W direction can be eliminated in that either the video signal or the three chrominance signals are differently delayed in a suitable way from line to line. This becomes possible with the aid of a color picture reproduction unit, in which the necessary delays are determined by using a color picture tube according to the invention.

BRIEF DESCRIPTION OF THE DRAWING

The invention will be better understood from a reading of the following detailed description in which.

DETAILED DESCRIPTION

Figure 1:
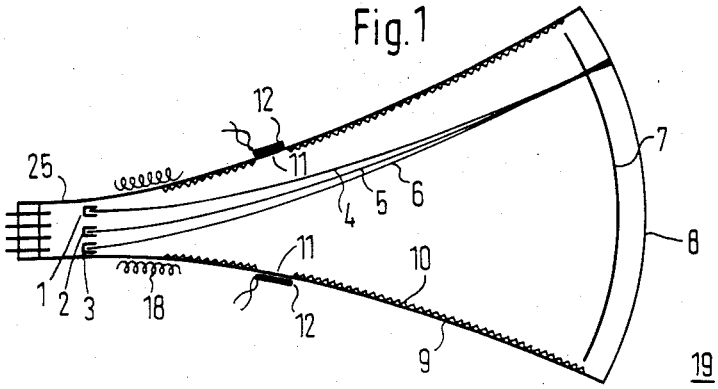
FIG. 1 is a sectional view taken through a color picture tube in accordance with the invention.

A color picture tube 19 according to the invention, shown in FIG. 1, includes a glass bulb 9, a screen 8, a (slit or) shadow mask 7, a glass tube neck 25, and three electron-gun systems 1, 2, 3 disposed inside the neck of the tube. The inside of the glass bulb 9 is provided with a non-transparent interior coating 10. To the outside of the color picture tube 19, at the transition between the neck of the tube 25 and the glass bulb 9, a deflection unit 18 is mounted. Electron beams 4, 5, 6 are produced by the electron-gun systems 1, 2, 3, and deflected within the area of the deflection unit 18. These electron beams are supposed to intersect each other in the slits or holes of the shadow mask 7. A color picture tube according to the invention, in addition thereto, still comprises at least one opening 11 in the interior coating 10. At each point of the glass bulb 9, where an opening is provided for on the inside in the interior coating 10, a possibility is provided for on the outside for attaching a photo-sensitive element 12 which is attached or capable of being attached in such a way that light impinging upon the associated opening 11, is capable of being detected. This light comes from the shadow mask 7 which, in FIG. 1, is merely shown schematically.

Figure 2:
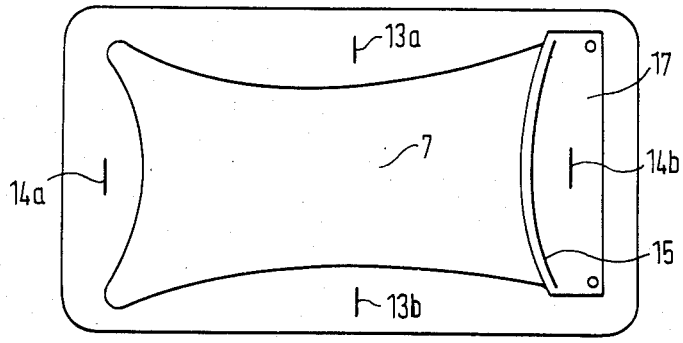
FIG. 2 schematically shows the shadow mask of a color picture tube according to the invention, in a rear view.

The alterations on the shadow mask 7, which are proposed by this invention, are further explained with reference to FIG. 2. This drawing shows the rear view of the shadow mask 7 of a color picture tube according to the invention. The shadow mask 7 is fixed on the front side of a holder 16, and the edges of the shadow mask 7 are covered on the rear side by the holder 16. On the right-hand side, which corresponds to the left-hand side of the picture to be viewed from the front, a mark support 17 is fixed to the holder 16. Marks 13*a*, 13*b*, 14*a*, 14*b*, 15 are provided for which consist of a material which, upon impingement of an electron beam, emits either visible or UV light. Preferably, the marks consist of phosphor strips. In the given examples, the marks 13, 14, 15 are attached to the holder 16 or to a mark support 17 disposed thereon. It is also possible, to apply the marks directly to the shadow mask 7 within the marginal range thereof which, however, may not be "shadowed" with respect to the electron beams 4, 5, 6 by the holder 16. Both, the kind of marks and the way in which they are applied, are to be chosen thus that by this each time a certain correctable error becomes recognizable. The openings 11 in the interior coating 10 of the glass bulb 9 and the associated light-sensitive elements 12, however, are to be chosen such that from each of the light-sensitive elements a large as possible portion of the light as emitted by the marks, can be received, and that each flash of light emitted by any portion of a mark, is detectable by at least one of the light-sensitive elements 12. Whether a light-sensitive element 12 is to be attached firmly or only temporarily, for example, by applying a corresponding test head, chiefly depends on whether with the aid of the light as received by this particular light-sensitive element 12, alignment works are to be carried out once only, or whether checks are to be carried out at regular intervals.

To the mark support 17 there is attached a mark 15 which extends substantially in the vertical direction and which during the proper use of the color picture tube is intersected by each line of the line raster as written on the screen. The point of intersection respectively lies as close as possible to the beginning of the respective line. Normally, a color picture tube is written with a raster extending on all sides by a few percent beyond the screen edge and, consequently, also beyond the apertured portion of the shadow mask. At the left-hand picture edge (on the right-hand side when looked at from behind) this substantially vertical mark 15 must lie within the range of this slight overwriting. Appropriately, the course of the substantially vertical mark 15 is chosen such that the imaginary continuation of the electron beams 4, 5, 6 beyond this mark 15 up to the screen 8, results in an exactly vertical straight line thereon. Considering that the shadow mask 7 with its holder 16 is exposed during manufacture high temperatures, and because neither the shadow mask 7 nor its holder 16 are flat (planar), it is appropriate to attach at least those marks which must have an exactly specified geometry, to a separate mark support. When the edge of the mark support 17 extends in parallel with such a mark, the edge may simultaneously serve as a template during application of the mark. In the example, this applies to the substantially vertical mark 15. In this case, due to the very slight overwriting the edge of the mark support 17 must extend very near to the mark 15.

Figure 3:
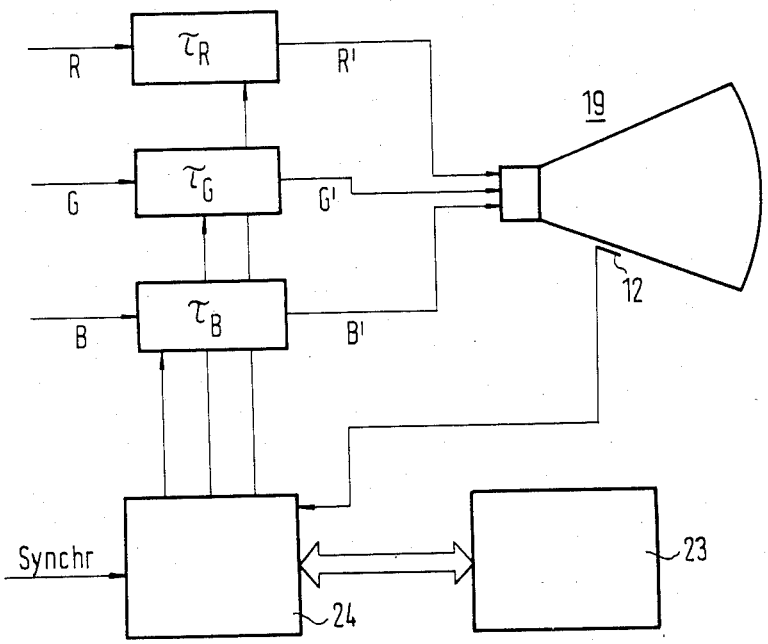
FIG. 3 shows part of the block diagram of a color picture reproduction unit according to the invention.

It is impossible to design a deflection unit in such a way that the three electron beams 4, 5, 6 converge exactly within the entire picture range. It is possible, however, to improve the convergence in one direction, preferably in the N-S direction, at the expense of the convergence in the other direction, that is, then in the E-W direction. The convergence in the E-W direction, however, can be still further improved by taking diversified switching measures. This will now be explained in greater detail with reference to FIG. 3. There is shown part of a block diagram relating to a color picture reproduction unit. Th chrominance signals R, G and B are fed to the three electron-gun systems 1, 2, 3 of the color picture tube 19 via adjustable delay devices 20, 21, 22. The respective time delays of the three delay devices 20, 21, 22 are adjusted by a control device 24 individually for each particular line. For this purpose, a synchronizing signal is fed to the control device 24 from which it is possible to determine both the beginning of the lines and the picture and, consequently, the beginning and the number of lines. To the control device 24, a digital data memory 23 is connected, from the stored data of which the control device 24 is capable of determining for each particular line the three different delay times. The delay times may be stored separately for each delay device and for each line. Also, the respective difference with respect to a defined time may be stored. It may also be sufficient to store the times or time differences relating to only some of the lines, and to obtain from this the remaining values via interpolation. It is also possible for the coefficients of corresponding functions, such as of approximation polynomials to be stored.

It may be sufficient to fix the data as contained in the data memory 23, either during the first adjustment at the factory or during servicing, and to maintain them without being changed in the course of time. In that case, a read-only memory (ROM) will have to be used as a digital data memory 23.

In the case of maximum requirements, it may be necessary to continuously consider deviations in the convergence which are due to aging. In this case it is necessary for the digital data memory 23 to be of the type which is programable at any time, with this programming capable of being carried out from the control device 24. The control device 24 must cause a re-programming of the data memory 23 from time to time, especially each time the unit is put into operation. For this purpose, the control device 24 is connected to at least one photosensitive element 12 attached to the color picture tube 19. It chiefly controls in the course of this, the following sequence: By each of the three electron-gun systems 1, 2, 3 a line raster is written alternatingly. The time positions at which the substantially vertical mark 15 of the color picture tube 19 is hit by the respective electron beam 4, 5, 6 are detected. From this the times are determined which the respective electron beam 4, 5, 6 requires for extending from the left-hand edge of the raster to the mark 15. For each of the electron-gun systems 1, 2, 3, that is, for each color, the times as ascertained, or their differences from a specified time, are stored at least for a part of the lines or the coefficients of a function containing these statements, e.g., an approximation polynomial, in the data memory 23. Thereafter there is effected a switching over to normal picture reproduction.

In cases where a read-only memory (ROM) is used as the data memory 23, the aforementioned method of determining the data contents must be carried out on the otherwise readily assembled and adjusted unit either at the factory or during servicing.

What is claimed is:

1. A color picture tube comprising:

a glass bulb having a non-transparent interior coating;

three electron gun systems disposed in said glass bulb;

a screen closing one end of said glass bulb;

a shadow mask assembly disposed between said three electron gun systems and said screen;

at least four phosphor strip portions on said shadow mask assembly on the side thereof facing said three electron gun systems, each of said phosphor strip portions transmitting light upon impingement by an electron beam and each of said phosphor strip portions being associated with the center of a corresponding edge of said shadow mask assembly, a plurality of openings in said interior coating, each of said openings optically coupled with a corresponding one of said phosphor strips; and photo sensitive means outside said glass bulb for detecting light emitted from said phosphor strip portions through said plurality of openings; and a substantially vertical phosphor strip on said shadow mask assembly which extends in such a way that each line of a line raster intersects said vertical phosphor strip near the beginning of the line.

2. A color picture tube in accordance with claim 1 wherein said vertical phosphor strip extends in such a way that a continuation of electron beams from said electron gun systems on to said screen results in an exactly vertical line.

3. A color picture tube in accordance with claim 1 wherein:

said shadow mask assembly comprises a shadow mask and a holder; and said substantially vertical phosphor strip is attached to a support which is attached to said holder.

4. A color picture tube in accordance with claim 1 wherein said substantially vertical phosphor strip is attached to a rim portion of said shadow mask assembly.

5. A color picture tube in accordance with claim 3 wherein said support has an edge toward the center of the picture extending at a small distance from said substantially vertical phosphor strip and parallel thereto.

6. A color picture reproduction unit comprising:

a color picture tube comprising a glass bulb having a non-transparent interior coating; three electron gun systems disposed in said glass bulb; a screen closing one end of said glass bulb; a shadow mask assembly disposed between said three electron gun systems and said screen; at least four phosphor strip portions on said shadow mask assembly on the side thereof facing said three electron gun systems, each of said phosphor strip portions transmitting light upon impingement by an electron beam and each of said phosphor strip portions being associated with the center of a corresponding edge of said shadow mask assembly, a plurality of openings in said interior coating, each of said openings optically coupled with a corresponding one of said phosphor strips; and photo sensitive means outside said glass bulb for detecting light emitted from said phosphor strip portions through said plurality of openings; and a substantially vertical phosphor strip on said shadow mask assembly which extends in such a way that each line of a line raster intersects said vertical phosphor strip near the beginning of the line;

three delay devices each coupled to one of said three electron gun systems for effecting an adjustable delay of an associated chrominance signal;

a digital data memory;

a control device for adjusting the duration of delay of said three delay device with respect to each line in response to data from said memory.

7. A color picture reproduction unit in accordance with claim 6 wherein:

said memory comprises a read only memory.

8. A color picture reproduction unit in accordance with claim 6 wherein:

said memory is programable;

said control device being adapted to cause a reprogramming of said memory each time the unit is put into operation in accordance with the following sequence:

each of said three electron guns writes in line raster, the times that said substantially vertical phosphor strip is hit by the electron beams are detected, the times required by the respective electron beams to extend from said edge to said substantially vertical phosphor strip are determined for each of said electron gun systems, data based on said times are stored in said data memory, and thereafter said unit switches over to normal picture reproduction.

9. A color picture reproduction unit in accordance with claim 8 wherein:

said data comprises coefficients of an approximation polynomial.

* * * * *